United States Patent [19]

Mapp

[11] 4,085,541

[45] Apr. 25, 1978

[54] ILLUMINATED HOOP TOY

[76] Inventor: Calvin R. Mapp, 1125 NW. 88th St., Miami, Fla. 33150

[21] Appl. No.: 765,843

[22] Filed: Feb. 4, 1977

[51] Int. Cl.[2] ..... A63H 33/26

[52] U.S. Cl. ..... 46/228; 46/220; 362/184

[58] Field of Search ..... 46/220, 228; 240/6.4 R

[56] References Cited

U.S. PATENT DOCUMENTS

| | | | |
|---|---|---|---|
| 989,944 | 4/1911 | Bramson | 46/228 |
| 3,604,149 | 9/1971 | Salontai | 46/220 |
| 3,619,942 | 11/1971 | de Lara | 46/228 X |
| 3,911,264 | 10/1975 | Chao | 46/228 |
| 4,006,556 | 2/1977 | Williams | 46/228 |

*Primary Examiner*—Louis G. Mancene
*Assistant Examiner*—Robert F. Cutting
*Attorney, Agent, or Firm*—Jack E. Dominik; William A. Newton

[57] ABSTRACT

A hollow clear plastic hoop has a pair of metal rings embedded in opposed sidewalls. Each ring has an exposed contact surface and the rings electrically connect in parallel a plurality of spaced bulbs in the interior of the hoop. The hoop is rolled by a stick device having a pair of insulated spaced wires in series with a battery and switch on a piston grip handle. As the hoop is rolled, intermittent contact is made by the wires with the metallic rings to establish a circuit to flash the bulbs in the hoop.

5 Claims, 4 Drawing Figures

ILLUMINATED HOOP TOY

BACKGROUND OF THE INVENTION

This invention relates to a toy, and more particularly, to a rolling hoop propelled by a stick device along a surface.

The rolling or trundling of hoops using a stick in contact with the outer surface of the hoop has been a favorite recreational pastime for children for decades, providing fun and exercise for the child as he pushes the hoop with a stick. The resulting increase in motor traffic on roadways near where children may be playing has made hoop rolling dangerous since the child might pursue a rolling hoop onto the roadway. Accordingly, this invention provides a stick device for the hoop which slidingly, but captively, engages the circumference of the hoop preventing the hoop from accidentally rolling onto a roadway and also includes a series of illuminating devices which are intermittently activated by the stick device to warn adjacent motorists that a child is playing adjacent the roadway. Furthermrre, the intermittent flashing of the illuminating devices provides an additional source of amusement for the child, simulating sparks generated by contact of the hoop with a friction surface.

SUMMARY OF THE INVENTION

In accordance with the invention, the hoop is made from hollow, clear plastic and includes a metal strip embedded in opposed sidewalls connecting a series of spaced bulbs in the hoop in electrical parallel between the strips. A stick device for propelling the hoop includes a pair of wires having an insulated U-shaped and bent back upon itself to form a pocket contacting the opposed sides and metal strips of the hoop as it is rotated. The wires are connected in series to a battery and switch in the handle of the stick device so that as contact is intermittently made between the sides of the hoop and wires on the stick device, a circuit is simultaneously established through the metallic strips to activate the parallel mounted bulbs. The bulbs may be different colors to provide an unusual and amusing lighted display as the hoop is rolled.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
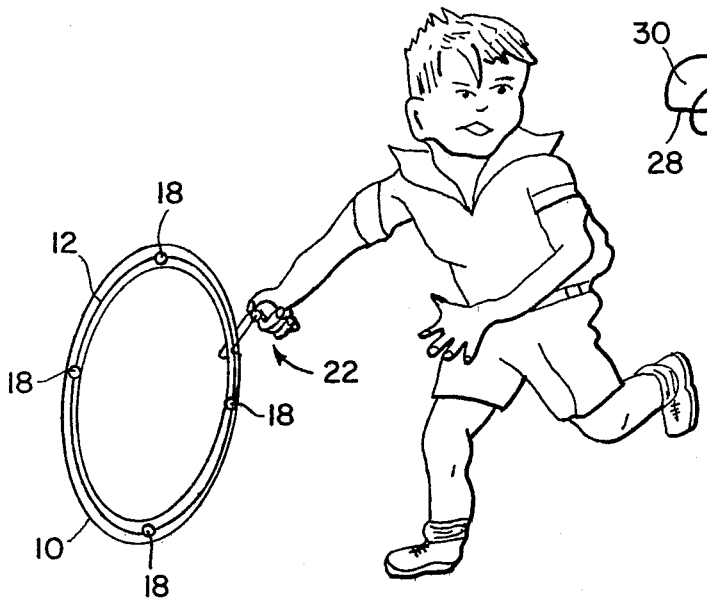
FIG. 1 is a perspective view of the illuminated hoop toy of the invention being rolled by a child.
Figure 2:
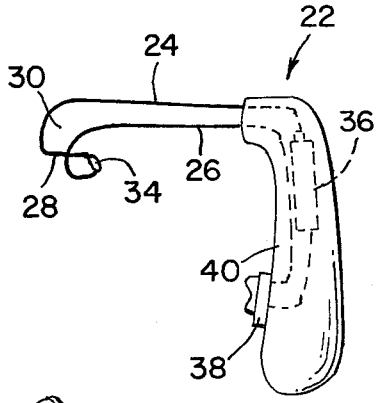
FIG. 2 is a side view in elevation of the stick device for rolling the hoop of FIG. 1.
Figure 3:
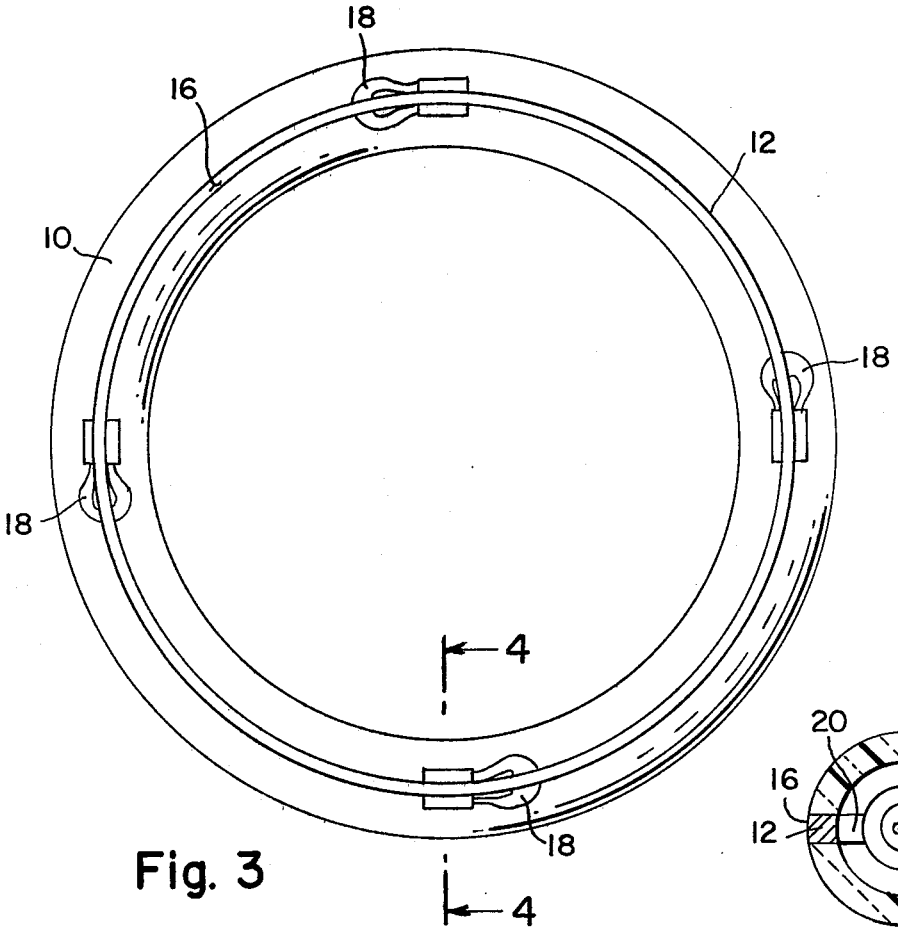
FIG. 3 is a side view in elevation of the hoop of FIG. 1.
Figure 4:
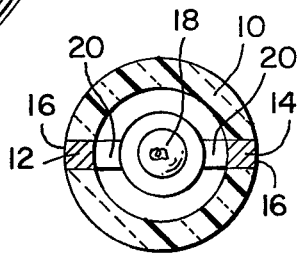
FIG. 4 is a cross-sectional view taken substantially along the plane indicated by line 4—4 of FIG. 3.

Referring now to the drawing in detail, wherein like numerals indicate like elements throughout the several views, a hollow hoop 10 of the present invention is made from clear plastic material and includes a ring of metal 12, 14 embedded in opposite portions of the sidewall of hoop 10. The rings 12, 14 have an outer exposed surface 16. A series of spaced light bulbs 18 within the hollow interior of hoop 10 are connected between rings 12 and 14 in electrical parallel relation by conductors 20. The bulbs 18 may be of different or the same color.

A stick device 22 for rolling and propelling hoop 10 is provided and includes a pair of parallel conductive wires 24, 26 having a U-shaped end portion 28 joining the wires together but bent back upon itself to form a pocket 30 for contact with the opposite sides of hoop 10 and metal rings 12, 14 as the hoop is rotated. The bight of the U-shaped end portion 28 is insulated as shown at 34 to preclude a direct electrical connection between wires 24 and 26.

The wires 24 and 26 are connected in series to a battery 36 and a switch 38 mounted in and on, respectively, an insulated handle grip 40 of the stick device 22.

In use, contact is intermittently made by wires 24 and 26 with the rings 12 and 14, respectively, on the sides of hoop 10 as the hoop 10 is rolled and pushed in pocket 30 of stick device 22. This intermittently establishes a circuit from battery 36 through switch 38 to each of bulbs 18 to intermittently activate and flash the bulbs as contact is made between the wires 24 and 26 and the metallic rings 12 and 14.

While a specific embodiment of an illuminated hoop toy has been disclosed in the foregoing description, it will be understood that various modifications within the spirit of the invention may occur to those skilled in the art. Therefore, it is intended that no limitations be placed on the invention except as defined by the scope of the appended claims.

I claim:

1. An illuminatable hoop toy comprising:

a hoop adapted to be rolled along a surface;

an electrically conductive ring embedded in opposed sidewalls of said hoop, each of said rings having an exposed electrically conductive surface on its respective sidewall;

a plurality of spaced bulbs mounted in electrical parallel relationship in said hoop between said conductive rings; and stick means adapted to contact said exposed conductive surfaces of said rings mounted on said hoop for propelling said hoop along a surface and for illuminating said bulbs in said hoop.

said stick means including an electrical power source with two terminals of opposite polarity, said stick means having a pair of spaced protruding conductive members, one of said conductive members electrically connected to one terminal of said power source and the other protruding conductive member electrically connected to the other terminal of said power source, said pair of protruding conductive members disposed in spaced apart relationship for simultaneous eletrical contact with said exposed conductive surfaces whereby one member electrically engages one said exposed conductive surface and said other member electrically engages said other exposed conductive surface.

2. The toy of claim 1, wherein said stick means includes:

said pair of conductive members defining a U-shaped end portion, said U-shaped end portion having an insulated portion interconnecting the ends of said pair of conductive members, whereby said U-shaped end portion of said pair of conductive members with said insulated portion defines a pocket for receiving said hoop and for maintaining said spaced apart relationship of said pair of conductive wires so as to allow for said simultaneous electrical contact of said exposed conductive surfaces.

3. The toy of claim 1, wherein said bulbs are of different colors.

4. The toy of claim 1, a switch interposed in circuit interupting relationship between the source of power and one of said protruding wires.

5. The toy of claim 4, wherein said battery and said switch are disposed in an insulated handle grip of said stick means.

* * * * *